US008769770B2

(12) United States Patent
Kullman et al.

(10) Patent No.: US 8,769,770 B2
(45) Date of Patent: Jul. 8, 2014

(54) HINGE ARRANGEMENT

(75) Inventors: Marcus Kullman, Vikmanshyttan (SE); Robin Sundberg, Falun (SE)

(73) Assignee: SCA Hygiene Products AB, Gothenburg (SE)

( * ) Notice: Subject to any disclaimer, the term of this patent is extended or adjusted under 35 U.S.C. 154(b) by 743 days.

(21) Appl. No.: 13/060,087

(22) PCT Filed: Sep. 15, 2008

(86) PCT No.: PCT/SE2008/051031

§ 371 (c)(1), (2), (4) Date: Feb. 22, 2011

(87) PCT Pub. No.: WO2010/030215

PCT Pub. Date: Mar. 18, 2010

(65) Prior Publication Data

US 2011/0139806 A1 Jun. 16, 2011

(51) Int. Cl.
*E05F 3/10* (2006.01)
*B65F 1/16* (2006.01)

(52) U.S. Cl.
USPC ..... 16/54; 16/50; 16/51; 16/49; 220/908; 220/830; 220/827

(58) Field of Classification Search
USPC ..... 16/50, 52, 54, 82, 445; 188/290; 220/830, 831, 832, 908; 62/449
See application file for complete search history.

(56) References Cited

U.S. PATENT DOCUMENTS 1,041,857 A * 10/1912 Nordqvist ..... 16/54
1,241,083 A * 9/1917 Bommer ..... 16/54
2,118,950 A * 5/1938 Stannard ..... 16/54
2,325,711 A * 8/1943 Seaman ..... 16/54
2,493,115 A * 1/1950 Diebel ..... 16/300

(Continued)

FOREIGN PATENT DOCUMENTS

CN 2698940 Y 5/2005
CN 1930046 A 3/2007

(Continued)

OTHER PUBLICATIONS

International Search Report, dated Jun. 8, 2009, from corresponding PCT application.

(Continued)

*Primary Examiner* — Fenn Mathew
*Assistant Examiner* — Chetan Chandra
(74) *Attorney, Agent, or Firm* — Drinker Biddle & Reath LLP

(57) ABSTRACT

A hinge on a cover for a container, has a pivot axis and includes at least one first member fixed against rotation and at least one second member rotatable about the axis, which first and second members are arranged coaxially along the axis. A third member is arranged coaxial with the first and second members. A damper element is provided between the first and the third members in order to dampen the relative rate of rotation between the members. A first spring is arranged between the second and the third tubular members, which first spring is connected to the respective second and third members so that relative rotation between the tubular members is permitted in a first direction, when the cover is pivoted towards a first position, and prevented in a second direction, when the cover is pivoted towards a second position. A container provided with such a hinge is described.

17 Claims, 6 Drawing Sheets

(56) References Cited

U.S. PATENT DOCUMENTS

| | | | | |
|---|---|---|---|---|
| 3,860,993 | A * | 1/1975 | Matuska | 16/52 |
| 4,190,925 | A * | 3/1980 | Koivusalo | 16/54 |
| 4,760,621 | A * | 8/1988 | Stromquist | 16/85 |
| 4,893,522 | A * | 1/1990 | Arakawa | 464/180 |
| 5,109,571 | A * | 5/1992 | Ohshima et al. | 16/307 |
| 5,142,738 | A | 9/1992 | Ojima | |
| 5,165,507 | A * | 11/1992 | Ohshima | 188/290 |
| 5,170,530 | A * | 12/1992 | Kopec et al. | 16/52 |
| 5,211,269 | A * | 5/1993 | Ohshima | 188/290 |
| 5,383,253 | A * | 1/1995 | Lin | 16/54 |
| 5,432,977 | A * | 7/1995 | Reid et al. | 16/52 |
| 5,511,807 | A * | 4/1996 | Snyder | 280/47.26 |
| 5,855,040 | A * | 1/1999 | Lin | 16/50 |
| 6,178,597 | B1 * | 1/2001 | Suzuki et al. | 16/330 |
| 6,336,252 | B1 * | 1/2002 | Bando | 16/307 |
| 6,857,538 | B2 * | 2/2005 | Lin | 220/830 |
| 6,866,588 | B2 * | 3/2005 | Doornbos | 464/40 |
| 6,922,869 | B2 * | 8/2005 | Bivens et al. | 16/54 |
| 7,418,279 | B2 * | 8/2008 | Takagi | 455/575.1 |
| 7,921,511 | B2 * | 4/2011 | Johnson | 16/60 |
| 7,971,318 | B2 * | 7/2011 | Kim et al. | 16/330 |
| 8,006,857 | B2 * | 8/2011 | Lin | 220/254.5 |
| 8,015,665 | B2 * | 9/2011 | Pan | 16/50 |
| 8,074,833 | B2 * | 12/2011 | Yang et al. | 220/831 |
| 8,186,539 | B2 * | 5/2012 | Lin | 220/830 |
| 8,307,503 | B1 * | 11/2012 | Burger | 16/277 |
| 8,387,210 | B2 * | 3/2013 | Sawa | 16/50 |
| 8,439,172 | B2 * | 5/2013 | Lee | 188/290 |
| 2001/0017247 | A1 * | 8/2001 | Machida | 188/290 |
| 2002/0000022 | A1 * | 1/2002 | Schillaci et al. | 16/319 |
| 2007/0001357 | A1 | 1/2007 | Kojima et al. | |
| 2007/0075030 | A1 | 4/2007 | Delli Venneri | |
| 2008/0179327 | A1 * | 7/2008 | Lin | 220/264 |
| 2010/0287729 | A1 * | 11/2010 | Jin et al. | 16/52 |
| 2011/0041285 | A1 * | 2/2011 | Hong | 16/54 |

FOREIGN PATENT DOCUMENTS

| | | | | |
|---|---|---|---|---|
| DE | 3303797 | A1 * | 8/1984 | E05F 1/12 |
| DE | 20 2004 003 159 | | 8/2005 | |
| EP | 0 263 376 | | 4/1988 | |
| EP | 396354 | A2 * | 11/1990 | E05F 3/14 |
| EP | 545624 | A2 * | 6/1993 | E05F 3/10 |
| EP | 1 335 090 | | 8/2003 | |
| EP | 1 582 479 | A1 | 10/2005 | |
| FR | 2 754 797 | A1 | 4/1998 | |
| JP | 52052452 | A * | 4/1977 | E05F 3/08 |

OTHER PUBLICATIONS

Chinese Office Action dated Mar. 28, 2013 in corresponding Chinese Patent Application No. 200880131143.9 (11 pages including English translation).

Extended European Search Report, dated Jan. 28, 2014, from corresponding EP App. No. 08813528.0.

* cited by examiner

HINGE ARRANGEMENT

TECHNICAL FIELD

The present invention is related to a container provided with a hinged lid or cover, which is arranged to perform a controlled closing movement.

BACKGROUND ART

Restrooms, restaurants and other public facilities are often provided with various containers comprising a lid or cover. In the case of a container such as a waste bin, a lid may be provided for reasons of hygiene or for giving the waste bin an aesthetic appearance by covering the contents of the waste bin. In the case of a container such as a dispenser, an outer cover may additionally be provided for enclosing and protecting the products to be dispensed.

A common type of cover is pivotally mounted on the waste bin and may or may not be spring loaded towards a closed position.

During closing, a lid or cover of this type often makes a loud noise as it contacts an upper surface or an edge of the container. Also, a rapidly closing lid or cover arranged to close under its own weight or by means of a spring load may create problems during servicing or use of a container such as a waste bin or a dispenser. Service personnel may experience problems when servicing and emptying a waste bin or when servicing and re-filling a dispenser. A further problem for waste bins is that users may have to use both hands to deposit waste in the bin, if the closing of the cover is unpredictable or too rapid. Hence there is a need for a hinge arrangement that solves the above problems for these types of containers.

U.S. Pat. No. 6,857,538 shows a known cover assembly that includes a ring mounted on a garbage bin, a cover mounted on the ring and a slot pivot device for slowly pivoting the cover relative to the ring. The slow pivot element includes an internal tube, an external tube enclosing the internal tube and a spring connected between the internal tube and the external tube. Rotation of the internal tube relative to the external tube exerts a torque on the spring. The spring is received in the internal tube so that an end thereof is connected with the internal tube. The internal tube is received in the external tube so that the other end of the spring is connected with the external tube. Damping oil is provided between the internal tube and the external tube so as to damp pivot of the internal tube relative to the external tube. A disadvantage with this solution is that a user opening the cover must apply sufficient force not only to lift the cover against the torque exerted by the spring, but to overcome the resistance created by the damping element. A further disadvantage is that the lid will automatically begin to close during servicing of the waste bin, requiring the user to support the lid at the same time as the service is performed.

The object of the invention is to provide an improved hinge arrangement in order to solve the above problems relating to the opening and closing of waste bin lids and dispenser covers. A further object of the invention is to solve the problem relating to the automatic closing of such lids or covers during servicing.

DISCLOSURE OF INVENTION

The above problems have been solved by a hinge arrangement and a container provided with such a hinge arrangement, according to the appended claims.

The invention relates to a hinge on a cover for a container. In the subsequent text the term cover has been used to include all types of lids and covers for use with containers such as waste bins or dispensers. The hinge has a pivot axis and comprises at least one first member fixed against rotation and at least one second member rotatable about said axis, which first and second members are arranged coaxially along said axis. A third member is arranged coaxial with the first and second members. At least one of the first second and/or third members may have a substantially tubular shape. A damper or braking element is provided between the first and the third members in order to act as a slow pivot device and dampen the relative rate of rotation between said members. The damper or braking element provided between the first and the third members may comprise a damping fluid in the radial space between said members. In the subsequent text, the term "damper element" is used for this arrangement. The damping fluid may comprise a silicone fluid or other suitable fluid or oil, whereby the degree of damping may be adjusted by selecting a fluid with a predetermined viscosity and/or by varying the radial space between the members.

The hinge itself may be made from a suitable plastic material such as polystyrene (PS), polypropylene (PP), polyamide (PA), polyethylene (PE), polycarbonate (PC), acrylonitrile butadiene styrene (ABS), acetal polyoxy-methylene (POM), polymethyl methacrylate (PMMA), polyvinyl chloride (PVC), or suitable mixtures thereof. It may be noted that when a silicone oil is used in the damper, the hinge should not contain a plastic material that itself contains silicone.

A first spring is arranged between the second and the third members, which first spring is connected to the respective second and third members so that relative rotation between the said members is permitted in a first direction, when the cover is pivoted towards a first position, and prevented in a second direction, when the cover is pivoted towards a second position. The first spring is acted on by the second member and is arranged to expand and slide relative to the third member when the second member is being rotated in the first direction. For example, the first spring may be a coil spring mounted around the outer periphery of a section of the third member. The coil spring and the said section of the third member may be located in a cylindrical recess in the second member. One end of the coil spring may be attached to or be acted on by the second member, while the opposite end of the coil spring is a free end located in the space between the second and third members. Rotation of the second member in the first direction causes an expansion of the coil spring so that the inner diameter of said spring is increased. The first spring will then be freely rotatable relative to the third member.

Similarly, the first spring is acted on by the second member and is arranged to contract and be locked relative to the third member when the second member is being rotated in the second direction. In the case of the coil spring described above, Rotation of the second member in the second direction causes a contraction of the coil spring so that the inner diameter of said spring is reduced. The first spring will then be clamped around the outer periphery of the third member, whereby relative rotation between the second and the third member is prevented. The second and the third member will then be rotated together as a unit.

In a first example, the damper element may be provided between at least an outer surface of the third member and an inner surface of the first member. According to a second example, the damper element may be provided between at least an inner surface of the third member and an outer surface of the first member. According to a third example, the damper element may be provided between an inner and an outer surface of the third member and an outer surface of the first member. The said inner and outer surfaces may comprise cooperating substantially cylindrical surfaces or conical surfaces with a relatively small cone angle, for instance up to 5°, preferably between 1-2°, in order to aid manufacture and assembly of these members.

Depending on the location of the damper element, a first end section of the third member may be arranged in a substantially cylindrical or annular recess in the first member. In addition, a second end section of the third member may be arranged in a substantially cylindrical or annular recess in the second member.

A second spring may be arranged between the first and second members. The second spring is connected to the respective first and second members so that rotation of the second member exerts a torque on said member towards the second position of the cover. Hence, when the cover is moved to the first position, the second member is rotated in the first direction relative to the fixed first member. The second spring may be, for instance, a coil spring, which is gradually tensioned or pre-stressed as the cover is moved to the first position. When the cover is released, the torque exerted on the second member by the coil spring will initiate the closing of the cover. As stated above, the movement towards the second position will be dampened, or resisted, by the damper element provided between the first and the third members.

In order to accommodate the first and second springs in the hinge, the at least one second member may comprise a first section containing the first spring and a second section containing the second spring. The first and second sections are preferably, but not necessarily mounted at opposite ends of the first member.

For example, the container may be a waste bin provided with a hinged cover comprising a hinge with such first and second springs. A user opening the cover by pivoting the cover in the first direction towards a first position, corresponding to the open position, is only required to overcome the action of the second spring as the damper element is inactive during rotation in the said first direction. When released, the cover will begin to move towards a second position, corresponding to the initial closed position, by pivoting in the second direction under the action of the second spring. The first spring will actuate the damping element which ensures that the closing movement will be performed in a controlled manner, at a relatively slow speed, by limiting the relative rate of rotation between the first and the third members.

The hinged cover for such a waste bin may also be provided with a blocking mechanism in order to prevent the lid from closing during servicing of the waste bin. The blocking mechanism may comprise a displaceable member actuated manually or by a suitable resilient or spring loaded means, such as a spring loaded bar that is actuated to block the hinge and maintain the lid in its open position. The blocking mechanism may comprise a spring loaded bar that is actuated when the lid is in its open position and a portion of the waste bin and/or a liner holder is opened or displaced from an initial position into a servicing position to allow the liner to be replaced. The displaced portion of the waste bin may be, for instance, a front or side section of the outer wall of the waste bin. The liner holder may be positioned at or near the upper portion of the waste bin, preferably below the hinged cover, where it supports a liner or bag for waste material. The spring loaded bar may be displaced or pivoted from a rest position to an active position by a suitable spring means. In its active position the spring loaded bar can be arranged to contact a portion of the hinge or the cover and prevent it from closing. As the opened or displaced portion of the waste bin and/or the liner holder is returned to the initial position, this displacement will cause the spring loaded bar to be returned to the rest position against the action of the spring means.

Manual actuation by means of releasable catch or an actuated linkage or lever may be used when it is desired to allow the user to determine if and when to activate and deactivate the displaceable member.

According to a further example, the container may be a dispenser provided with a cover hinged at the upper portion of the dispenser by a hinge comprising such first and second springs. A user opening the cover by pivoting the cover in the first direction towards a first position, corresponding to the open position, is only required to overcome the action of the second spring as the damper element is inactive during rotation in the said first direction. When released, the cover will begin to move towards a second position, corresponding to the initial closed position, by pivoting in the second direction under the action of the second spring. Depending on the degree of opening of the cover in the outwards and upwards direction, the second spring may be eliminated as the cover may return by gravity under its own weight. The damping element ensures that the closing movement will be performed in a controlled manner, at a relatively slow speed, by limiting the relative rate of rotation between the first and the third members.

The hinged cover for such a dispenser may also be provided with a blocking mechanism in order to prevent the cover from closing during servicing of the dispenser. The blocking mechanism may comprise a displaceable member actuated manually or by a suitable resilient or spring loaded means, such as a spring loaded bar that is actuated to block the hinge and maintain the cover in its open position. Actuation may be caused by the cover as it reaches its upper position, by depletion of the contents of the dispenser, by removal of a re-fill or by manual actuation.

For instance, the blocking mechanism may be held in an inactive position by physical contact with a roll or a stack of tissues or towels, whereby gradual depletion of the roll or stack will partially release the spring loaded bar. When the cover is opened for servicing of the container, the partially released spring loaded bar will be displaced into its active position and prevents the cover from closing. When the service is completed, a new roll or stack is placed in the dispenser. As the roll or stack is positioned in the dispenser it will simultaneously displace the spring loaded bar into its inactive position, whereby the cover is released and will begin to close. Alternatively, in a dispenser containing a re-fill container, such as a liquid soap container, the re-fill container itself may be used for controlling the blocking mechanism. In this case the cover is opened from an initial position into a servicing position to allow the re-fill container to be replaced. In this alternative example, a spring loaded bar is held in its inactive position by the re-fill container. During servicing, the cover is opened and held in its opened position to allow the re-fill container to be removed. Removal of the re-fill container causes the spring loaded bar to be released and displaced into its active position, whereby the cover is prevented from closing. When the service is completed, a new re-fill container is placed in the dispenser. As the re-fill container is positioned in the dispenser it will simultaneously displace the spring loaded bar into its inactive position, whereby the cover is released and will begin to close. In both alternative examples, the spring loaded bar in such a dispenser may be displaced or pivoted from a rest position to an active position by a suitable spring means. In its active position the spring loaded bar can be arranged to contact a portion of the hinge or the cover and prevent it from closing.

Manual actuation by means of releasable catch or an actuated linkage or lever may be used when it is desired to allow the user to determine if and when to activate and deactivate the displaceable member. This may be the case when, for instance, a leading edge of a roll is required to be threaded through a feeding mechanism after a replacement roll has been inserted during servicing. As this operation is dependent on the complexity of the feeding mechanism and the experience of the user in operating it, the timing of the release of the cover must then be decided by the user.

In general, when using a spring loaded bar, the said bar may be moved from an inactive position, parallel to the surface to which it is mounted, into an active position, at a predetermined angle relative to the said surface. In its active position the spring loaded bar may be arranged to contact a lower portion of the hinge and prevent a lid or cover from closing. To achieve this, the predetermined angle must be sufficient to allow the spring loaded bar to contact and block the lower part of the hinge, but preferably acute (less than 90°) so that the return movement of a liner holder in a waste bin or the re-filling of a dispenser is not prevented. The selection of a suitable angle is dependent on the direction of the said return movement relative to the active position of the spring loaded bar, or the actions performed when re-filling a dispenser. A blocking mechanism such as a spring loaded bar is preferably, but not necessarily, mounted on or adjacent a portion of the hinge.

According to a further example, the container may be a dispenser provided with a cover hinged at the lower portion of the dispenser by a hinge comprising such first and second springs. A user wishing to open the cover is only required to release the cover, for instance by actuating a locking mechanism. The cover will begin to move towards a second position, in this case corresponding to the open position, by pivoting the cover in the second direction under the action of the second spring. The first spring actuates the damping element which ensures that the opening movement will be performed in a controlled manner, at a relatively slow speed, by limiting the relative rate of rotation between the first and the third members. After re-filling or servicing the dispenser, the user will close the cover by pivoting the cover in the first direction towards a first position, here corresponding to the initial closed position. During this movement the user is only required to overcome the action of the second spring as the damper element is inactive during rotation in the said first direction. The closing movement will pretension the first spring so that it is ready to initiate the opening movement of the cover upon a subsequent release of the locking mechanism.

The invention further relates to a container provided with a hinge according to the invention. The container may, for instance, be a waste bin with a lid arranged to be pivoted, which lid attached to the waste bin by the said hinge. The hinge may be used for covers or lids being opened in any direction, for instance by pivoting in an upwards direction or a downwards direction. For hinges used in such applications, the first direction, as described above, will correspond to the opening of the cover and the second direction will correspond to the closing of the cover.

Alternatively, the container may be a dispenser with a cover arranged to be pivoted, which cover attached to the dispenser by a hinge according to the invention. Examples of such dispensers include wall mounted dispensers for wipes or tissues in the form of a roll or stack within the dispenser, or dispensers for liquid or viscous fluids such as soap, hand crème or similar. In such cases, the cover is opened to re-fill a dispenser. As stated above, the hinge may be used for covers being opened in an outwards and upwards direction, as well as covers being opened in an outwards and downwards direction.

For a hinge located at an upper portion of the dispenser where the cover is being opened in an outwards and upwards direction, the first direction, as defined above, will correspond to the opening of the cover and the second direction will correspond to the closing of the cover. In general, hinges where the user is required to perform an initial lifting movement may be provided with a locking or blocking device to maintain the cover open during servicing, re-filling, etc.

For a hinge located at a lower portion of the dispenser where the covers are being opened in an outwards and downwards direction, the first direction, as defined above, will correspond to the closing of the cover and the second direction will correspond to the opening of the cover. For dispensers of this type, the hinge will prevent the cover from dropping uncontrollably outwards and downwards. Also, as such covers are maintained in the opened position by gravity, the blocking mechanism described above may be dispensed with.

In the text of the description, the respective first and second positions and first and second directions are defined in relation to the function of the component parts of the hinge. Hence, if the initial movement of a cover or lid does not require damping, then the hinge is mounted to be pivoted in its first direction towards a first position. On the other hand, if the initial movement does require damping, then the hinge is mounted to be pivoted in its second direction towards a second position. If a second spring is provided, this second spring must be mounted so that its action is adapted to the action of the first spring.

In addition to the non-limiting examples given above, additional uses for the hinge according to the invention are possible within the field of containers for use in restrooms, restaurants and similar public areas.

BRIEF DESCRIPTION OF DRAWINGS

The invention will be described in detail with reference to the attached figures. It is to be understood that the drawings are designed solely for the purpose of illustration and are not intended as a definition of the limits of the invention, for which reference should be made to the appended claims. It should be further understood that the drawings are not necessarily drawn to scale and that, unless otherwise indicated, they are merely intended to schematically illustrate the structures and procedures described herein.

EMBODIMENTS OF THE INVENTION

Figure 1:
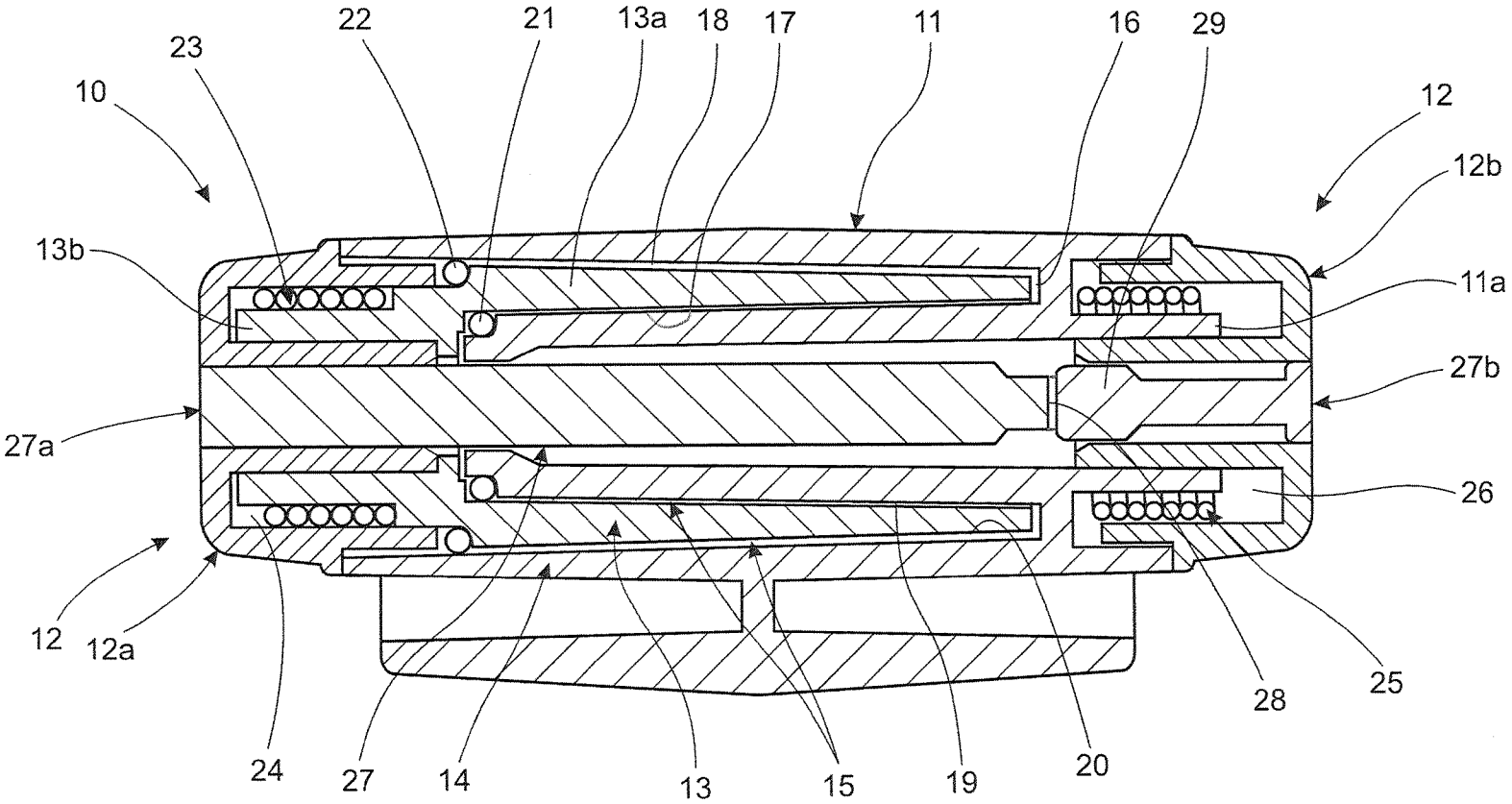
FIG. 1 shows a schematic cross-section through a hinge according to the invention.
Figure 3:
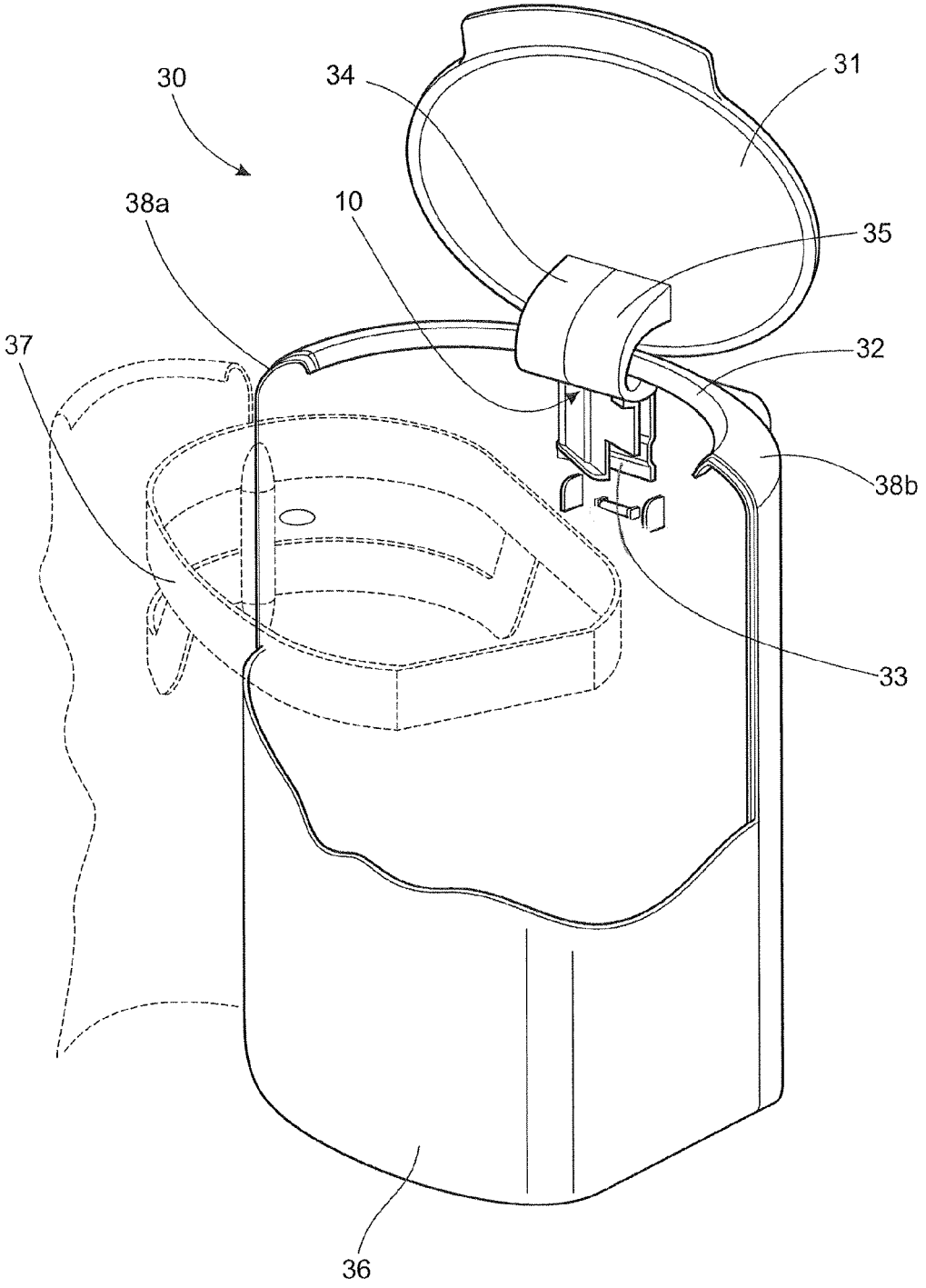
FIG. 3 shows a schematic illustration of a waste bin provided with a hinge according to the invention.

FIG. 1 shows a schematic cross-section through a hinge 10 according to the invention. The hinge in FIG. 1 is intended for a waste bin with a cover as shown in FIG. 3.

The hinge 10 has a pivot axis X and comprises a first tubular member 11 fixed against rotation and a pair of second tubular members 12*a*, 12*b* pivotable about said axis, which first and second tubular members 11; 12*a*, 12*b* are arranged coaxially along said axis X. The first tubular member 11 is attached to the waste bin (see FIG. 3) and the second tubular members 12*a*, 12*b* are pivotably mounted at opposite ends of the first tubular member. A third tubular member 13 is arranged coaxial with the first and second tubular members. The second tubular members 12*a*, 12*b* are both attached to the cover and are pivoted together. When the relative movement of the individual tubular members is described, the second tubular members 12*a*, 12*b* will sometimes be referred to as a "tubular member 12". A damper element 14 is provided between the first and the third tubular members 11, 13 in order to act as a slow pivot device and dampen the relative rate of rotation between said members. The damper element 14 comprises a predetermined volume of fluid filling a space 15 between the first and the third tubular members 11, 13. The fluid is a suitable oil with a viscosity selected dependent on the weight of the cover and the desired rate of rotation between the first and the third tubular members 11, 13 during closing of the cover. For instance, in a hinge made from plastics materials such as POM, ABS or PC, a silicone oil may be used.

As shown in the figure, the third tubular member 13 is located in an annular recess 16 in the first tubular member 11. The damper element 14 comprises a volume enclosed by radially inner and outer surfaces 17, 18 along a first end section 13*a* of the third tubular member 13 and respective radially inner and outer surfaces of the annular recess 16 in the first tubular member. In order to facilitate mounting of the first and the third tubular member 11, 13, the radially inner surface 19 of the first tubular member 11 and the radially outer surfaces of the third tubular member 13 are conical surfaces with a relatively small cone angle, in this case about 1-2°.

The space 15 is sealed with an inner and an outer O-ring 21, 22 located between the first and the third tubular members 11, 13 at the outer end of the annular recess 16. The silicone fluid fills the entire space 15 and is maintained in the space 15 by the two O-rings 21 and 22. The O-ring material can be any suitable natural or synthetic rubber material. In this example a synthetic rubber or a fluoropolymer elastomeric, such as Viton®, that can resist silicone fluids is used. The tubular members making up the hinge is made from ABS and PC. The O-rings shown in FIG. 1 are mounted on the first and the third tubular members and can withstand a fluid pressure of up to 10 bar. However, for alternative applications where a lower maximum pressure is allowed, other materials can be used for the hinge and O-rings, and greater tolerances may be used between the hinge and the O-rings.

A first spring 23 is arranged between one of the second tubular members 12*a* and the third tubular member 13, which first spring 23 is connected to the respective second and third tubular members 12*a*, 13 so that relative rotation between the said tubular members is permitted in a first direction, when the cover is pivoted towards a first position, corresponding to its open position, and prevented in a second direction, when the cover is pivoted towards a second position, corresponding to its closed position. The first spring 23 is acted on by the second tubular member 12*a* and is arranged to expand and slide relative to the third tubular member 13 when the second tubular member 12*a* is being rotated in the first direction. In this example, the first spring 23 is a coil spring mounted around the outer periphery of a second end section 13*b* of the third tubular member 13. The coil spring 23 and the said second end section 13*b* of the third tubular member 13 are located in a cylindrical recess 24 in the adjacent second tubular member 12*a*. One end of the coil spring 23 is acted on by the second tubular member 12*a*, while the opposite end of the coil spring 23 is a free end located in the recess 24 between the second and third tubular members 12*a*, 13*b*. Rotation of the second tubular member 12*a* in the first direction causes an expansion of the coil spring 23 so that the inner diameter of said coil spring 23 is increased. The first spring 23 will then be freely rotatable relative to the second end section 13*b* of the third tubular member 13.

Similarly, the first spring 23 is acted on by the adjacent second tubular member 12*a* and is arranged to contract and be locked relative to the second end section 13*b* of the third tubular member 13 when the second tubular member 12*a* is being rotated in the second direction. Rotation of the second tubular member 12*a* in the second direction causes a contraction of the coil spring 23 so that the inner diameter of said coil spring 23 is reduced. The coil spring 23 will then be clamped around the outer periphery of the second end section 13*b* of the third tubular member 13, whereby relative rotation between the second and the third tubular member 12*a*, 13 is prevented. The second and the third tubular member will then be rotated together as a unit.

A second spring 25 arranged between the first tubular member 11 and a further second tubular member 12*b*. The second spring 25 is connected to the respective first and second tubular members 11, 12*b* so that rotation of the further second tubular member 12*b* exerts a torque on said second tubular member 12*b* towards the second position, corresponding to the closed of the cover. Hence, when the cover is moved towards the first position, corresponding to the open position, the further second tubular member 12*b* is rotated in the first direction relative to the fixed first tubular member 11. The second spring 25 is a coil spring mounted around the outer periphery of an end section 11*a* of the first tubular member 11. The second coil spring 25 and the said end section 11*a* of the first tubular member 11 are located in a cylindrical recess 26 in the further second tubular member 12*b*. As the cover is moved towards its opened first position the second coil spring 25 is gradually tensioned or prestressed. When the cover is released, the torque exerted on the further second tubular member 12*b* by the second coil spring 25 will initiate the closing of the cover. As stated above, the closing movement will be dampened, or braked, by the damper element 14 provided between the first and the third tubular members 11, 13.

The first tubular member 11, the pair of second tubular members 12*a*, 12*b* and the third tubular member 13 are assembled to form a hinge 10. The assembled hinge 10 is held together by a snap-locking central axle 27. The central axle 27 comprises a first axle section 27*a* which is inserted into an opening through one of the second tubular members 12*a*, at the left hand side of FIG. 1. The first axle section 27*a* extends through an opening through the first tubular member 11 and into, but not through, an opening through the further second tubular member 12*b*. At its inner end, the first axle section 27*a* is provided with a central slot 28 (see FIG. 2) that allows the portions at either side of the slot 28 to be expanded. A second axle section 27*b* is inserted into the further second tubular member 12*b* at the opposite end of the hinge 10, at the right hand side of FIG. 1. The second axle section 27*b* is provided with a wedge shaped portion 29 at its inner end, which wedge shaped portion 29 is arranged to enter the slot 28, expand the end of the first axle section 27*a*, and snap into place in a recess in the slot 28. The wedge shaped portion 29 will maintain the inner end of the first axle section 27*a* in contact with the opening through the further second tubular member 12*b* and lock the first axle section 27*a* and the second axle section 27*b* together. Each of the first and the second axle sections 27*a*, 27*b* is provided with a T-shaped head for cooperation with a corresponding recess in the outer surface of their respective second tubular member 12*a*, 12*b*. In this way the central axle 27 is arranged to hold the assembled hinge 10 together.

Figure 2:
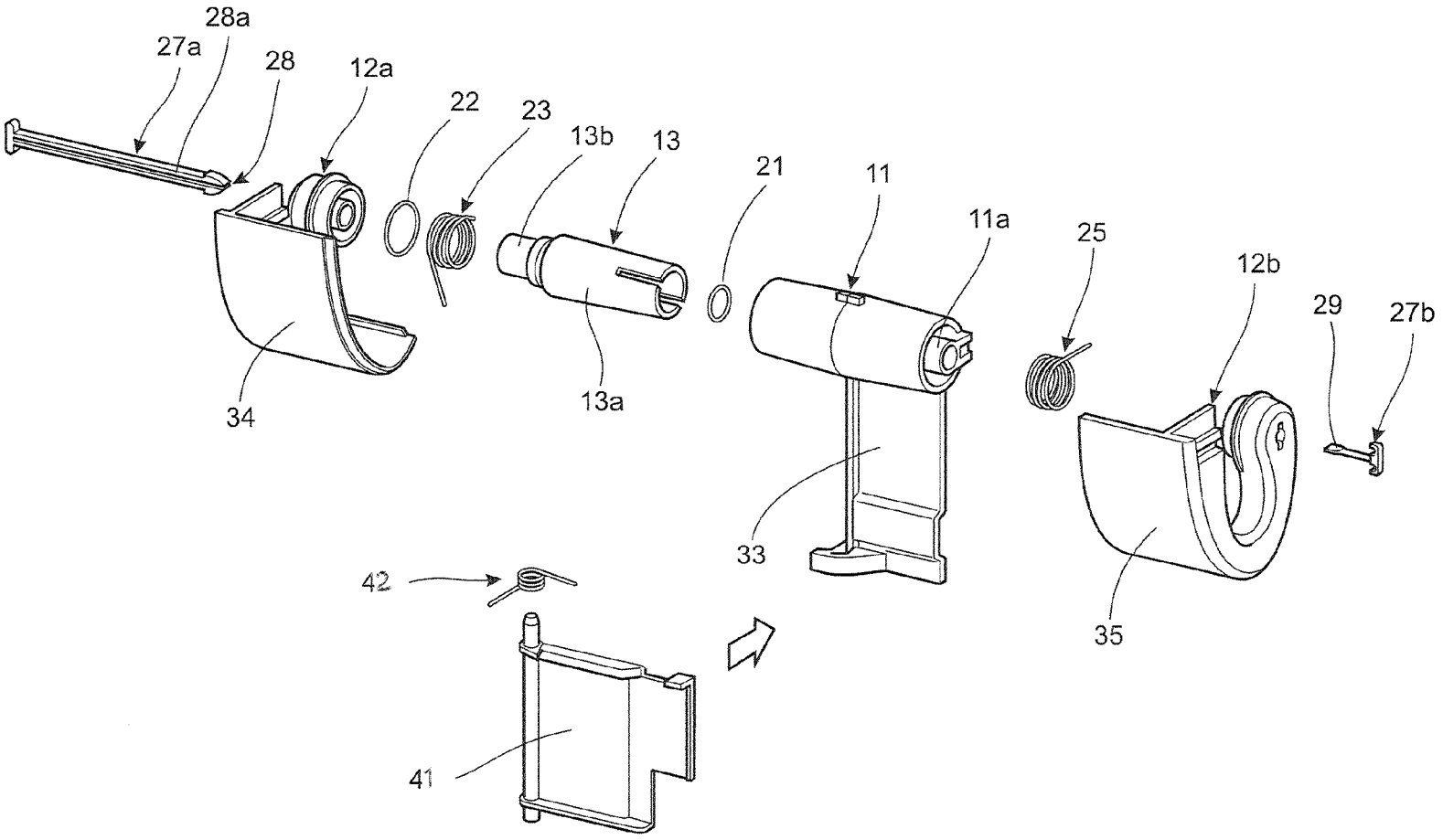
FIG. 2 shows an exploded view of the hinge in FIG. 1.

FIG. 2 shows an exploded view of the hinge in FIG. 1. In the order of assembly, the hinge 10 comprises a first tubular member 11 arranged to be attached to a waste bin (see FIG. 3) and to be fixed against rotation. A first, inner O-ring 21 is mounted around the inner diameter of an annular recess 16 (see FIG. 1) in the first tubular member 11. A first end section 13*a* of the third tubular member 13 is inserted into the said recess 16. Silicon oil can be filled into the annular recess 16 prior to this step. A second, outer O-ring 22 is mounted around an outer diameter of the third tubular member 13 at the outer end of the annular recess 16. The first coil spring 23 is mounted around the outer periphery of the second end section 13*b* of the third tubular member 13. One of the second tubular members 12*a* is mounted rotatably onto the first tubular member 11 around the first coil spring 23, so that the first coil spring 23 is arranged between the second tubular member 12*a* and the third tubular member 13. At the opposite end of the first tubular member 11, the second spring 25 is mounted around the outer periphery of an annular end section 11*a* of the first tubular member 11. The further second tubular member 12*b* is mounted rotatably onto the first tubular member 11 around the second coil spring 25, so that the second coil spring 25 is arranged between the first tubular member 11 and the further second tubular member 12*b*. Finally, the first axle section 27*a* extends through an opening through the first tubular member 11 and into, but not through, an opening through the further second tubular member 12*b*. In order to lock the component parts of the hinge together, the second axle section 27*b* is inserted into the further second tubular member 12*b* at the opposite end of the hinge 10. The second axle section 27*b* is provided with a wedge shaped portion 29 at its inner end, which wedge shaped portion 29 is arranged to enter the slot 28 at the end of the first axle section 27*a*, and snap into place in a recess 28*a* in the slot 28. An attachment plate 33 is attached to the first tubular member 11 to allow the hinge to be mounted on a suitable surface in a waste bin or a dispenser. In an alternative embodiment, a blocking bar 41 can be mounted at one side edge of the attachment plate 33 by means of a spring loaded hinge 42. The function of the blocking bar 41 is described in connection with FIGS. 3 and 4 below. This completes the assembly of the hinge 10 which can then be mounted to the waste bin shown in FIG. 3.

FIG. 3 shows a schematic illustration of a wall mounted waste bin 30 provided with a hinge 10 according to the invention; The waste bin 30 comprises a hinged cover 31, for an opening 32 in an upper surface of the waste bin 30, and a hinge 10 with first and second springs 23, 25 as described in connection with FIGS. 1-2. The hinge 10 comprises a first tubular member 11 (see FIG. 2) mounted to the upper rear wall of the waste bin 30 by means of an attachment plate 33. The hinge 10 further comprises a pair of second tubular members 12*a*, 12*b* (see FIG. 2) mounted to the cover 31 by means of a pair of swan neck holders 34, 35.

In operation, referring to FIGS. 1-3, a user opening the cover 31 by pivoting the cover in the first direction towards an opened, first position, is only required to overcome the action of the second coil spring 25 as the damper element 14 is inactive during rotation in the said first direction. When released from its fully or partially opened position, the cover 31 will begin to move towards a second position, corresponding to the initial closed position, by pivoting in the second direction under the action of the first coil spring 23. The damping element 14 ensures that the closing movement will be performed in a controlled manner, at a relatively slow speed, by limiting the relative rate of rotation between the first and the third tubular members 11,13.

Figure 4B:
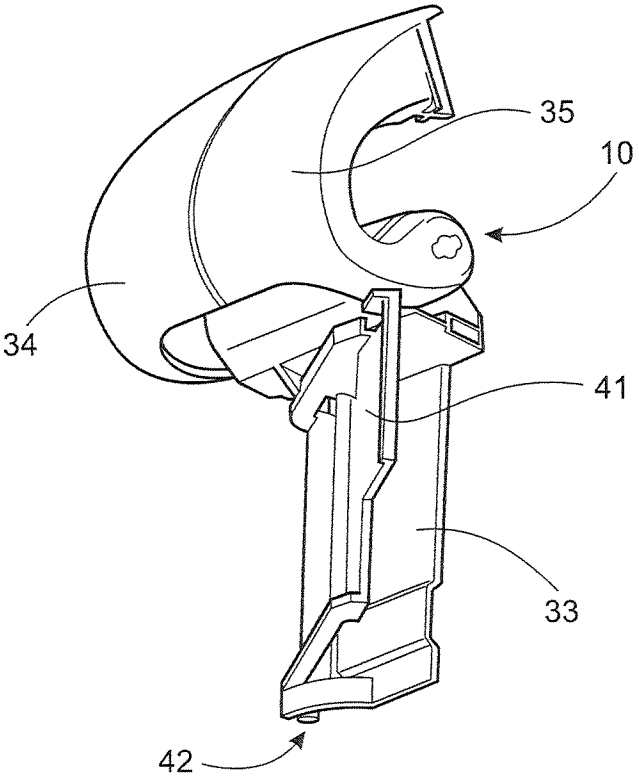
FIG. 4B shows a perspective view of the hinge in FIG. 3, with a blocking mechanism in an active position.
Figure 4A:
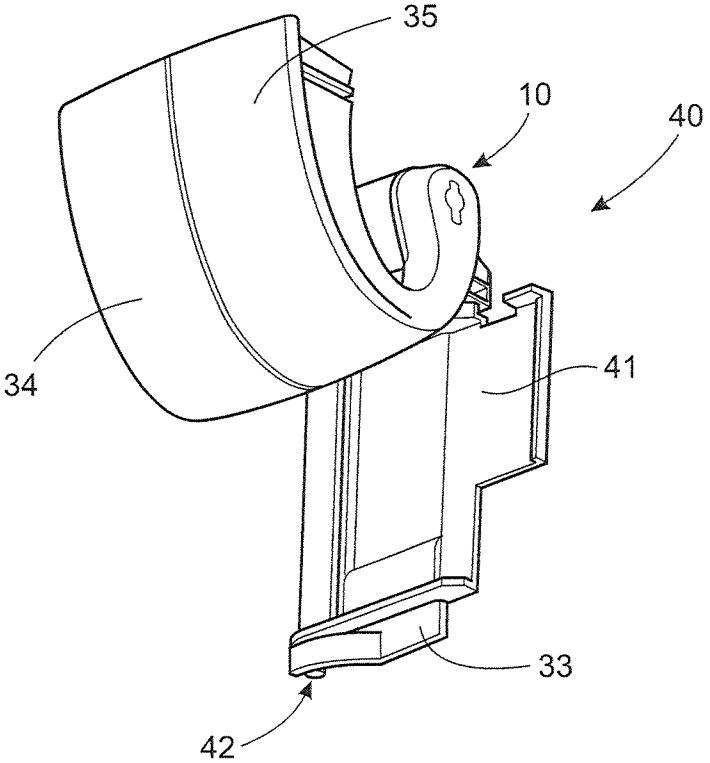
FIG. 4A shows a perspective view of the hinge in FIG. 3, with a blocking mechanism in an inactive position.

FIG. 4A shows the hinge 10 of FIG. 3 provided with a blocking mechanism 40, which mechanism is arranged to prevent the cover from closing during servicing of the waste bin. The blocking mechanism 40 comprises a spring loaded bar 41 that is actuated when the lid 31, as shown in FIG. 3, is in its open position and a front section 36 (shown partially removed in FIG. 3) of the waste bin and a liner holder 37 are opened or displaced from an initial position into a servicing position (schematically indicated with dashed lines) to allow the liner to be replaced. The liner holder 37 is positioned at the upper portion of the waste bin, below the hinged cover 31, where it is arranged to support a liner or bag for waste material. In this example, the displaced front section of the outer wall of the waste bin is attached to a side section 38*a* of the bin by means of pivot joints (not shown). The pivoting joints are mounted along a substantially vertical dividing line separating the front section 36 from the side section 38*a*. A similar vertical dividing line is provided at the opposite side section 38*b*, where a releasable locking device (not shown) is arranged to hold the front section 36 in place. When released, the front section 36 can be swung outwards about the pivot joints to expose the liner holder 37. The liner holder 37 is attached to the side section 38*a* of the bin by means of pivot joints (not shown) mounted to the side section 38*a* adjacent the rear wall of the waste bin. Once the front section 36 has been opened, the liner holder 37 can be swung outwards into a service position (not shown). Alternatively, the liner holder can be mounted in and pivoted together with the front section. FIG. 4A shows the spring loaded bar 41 in its inactive, or rest position where it is held in place by the liner holder 37. The spring loaded bar 41 is attached to the attachment plate 33 of the hinge by a spring loaded pivot joint 42. The pivot axis of the spring loaded bar 41 is arranged substantially vertically, parallel with the attachment plate 33. The pivot joint 42 comprises a coil spring arranged to act on the bar 41. When the liner holder 37 is swung outwards, the spring loaded bar 41 is released and pivoted from the inactive position, away from the attachment plate 33, to an active position by the coil spring, as shown in FIG. 4B. The spring loaded bar 41 is shown in its active position, at a predetermined angle relative to the attachment plate 33. In its active position the spring loaded bar 41 is arranged to contact a lower portion of one of the swan neck holders 35 of the hinge and prevent the cover from closing. To achieve this, the predetermined angle must be sufficient to allow the spring loaded bar 41 to contact and block the lower part of the swan neck holder 35, but preferably less than 90° so that the return movement of the liner holder 37 is not prevented. In the example shown in FIG. 4B, the angle can be between 30° and 45°. As the liner holder 37 is swung back and returned to the initial position, a rear portion of the liner holder 37 will act on an outer surface of the spring loaded bar 41. The displacement of the liner holder 37 will cause the spring loaded bar 41 to be returned to the rest position against the action of the spring loaded pivot joint 42. The cover 31 is then released and will begin to close, as described above.

Figure 5:
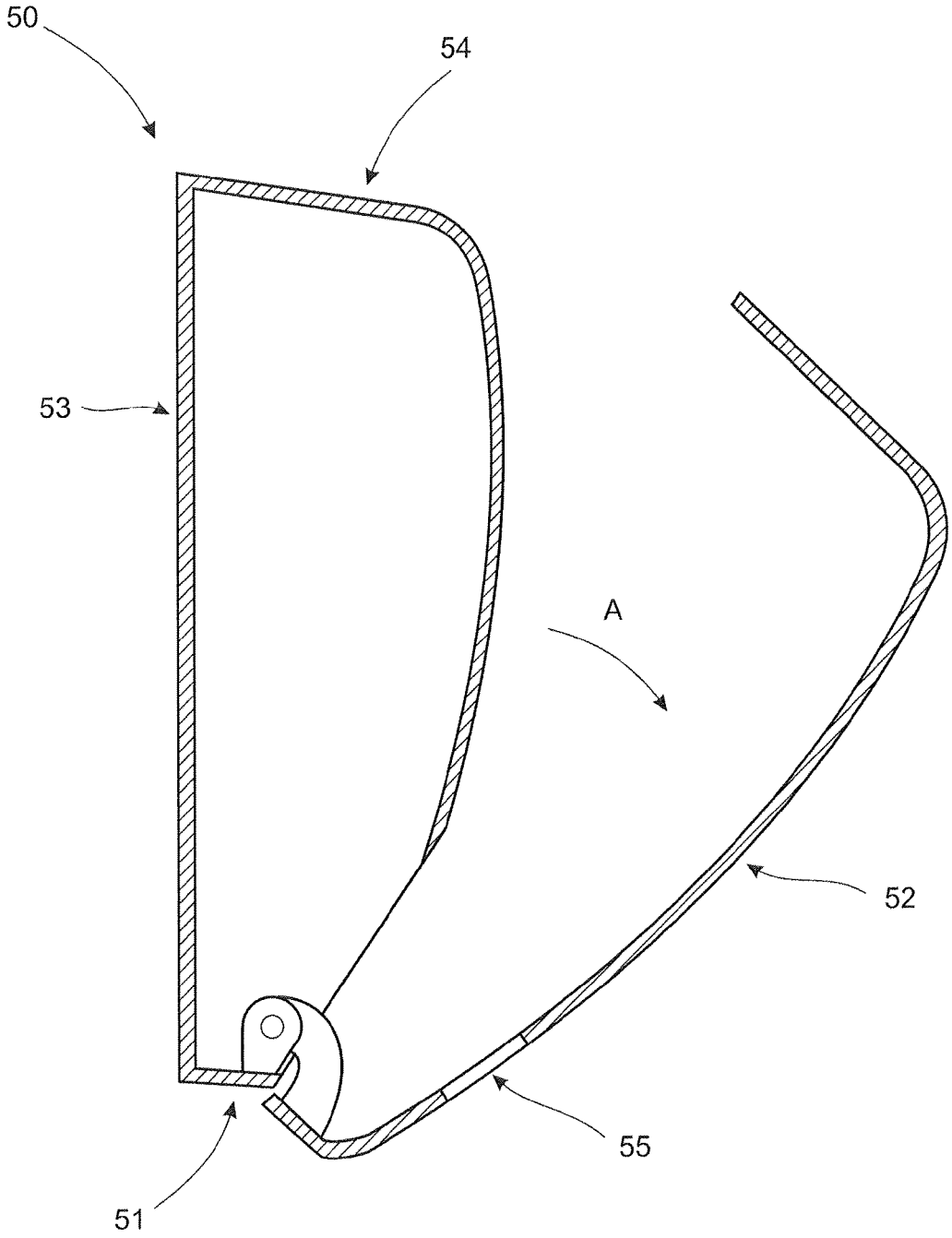
FIG. 5 shows a schematic illustration of a dispenser provided with a hinge according to the invention.

FIG. 5 shows a schematic illustration of a wall mounted dispenser 50 for a stack of paper towels or similar provided with a hinge 51 according to the invention. According to this example, the dispenser 50 is provided with a front cover 52 hinged at the lower portion of the dispenser 50 by the hinge 51. The dispenser 50 comprises a rear wall 53 and a body 54 having an upper section and two side walls (not shown) arranged to enclose a stack of towels. The front cover 52 is provided with a dispensing opening 55 and is opened outwards and downwards, as indicated by the arrow A, to allow access to the inside of the dispenser 50. In FIG. 5 the cover 52 is shown in an intermediate position, between its open and closed positions. The hinge 51 used for the dispenser 50 comprises a pair of first and second springs similar to the first and second coil springs described in connection with FIGS. 1-3 above. However, the springs used in the hinge 51 of FIG. 5 are coiled in the opposite direction to the first and second coil springs 23 and 25 described above. The effect of this is that the coil spring corresponding to the first coil spring 23 is acted on by the second tubular element when the cover 52 is opened, whereby the damper element is actuated to brake the outwards and downwards movement of the cover 52. Similarly, the coil spring corresponding to the second coil spring 25 is acted on and pre-stressed by the second tubular element when the cover 52 is closed.

In operation, referring to FIG. 5, a user wishing to open the cover 52 in order to re-fill or service the dispenser 50 is only required to release the cover 52, for instance by actuating a suitable locking mechanism (not shown). The cover 52 will begin to move towards a second position, in this case corresponding to the open position, by pivoting in the second direction under the action of the second spring. The damping element ensures that the opening movement will be performed in a controlled manner, at a relatively slow speed, by limiting the relative rate of rotation between the first and the third tubular members. After re-filling or servicing the dispenser, the user will close the cover by pivoting the cover in the first direction towards a first position, here corresponding to the initial closed position. During this movement the user is only required to overcome the action of the second spring as the damper element is inactive during rotation in the said first direction. The closing movement will pretension the second spring so that it is ready to initiate the opening movement of the cover upon a subsequent release of the locking mechanism.

Figure 6:
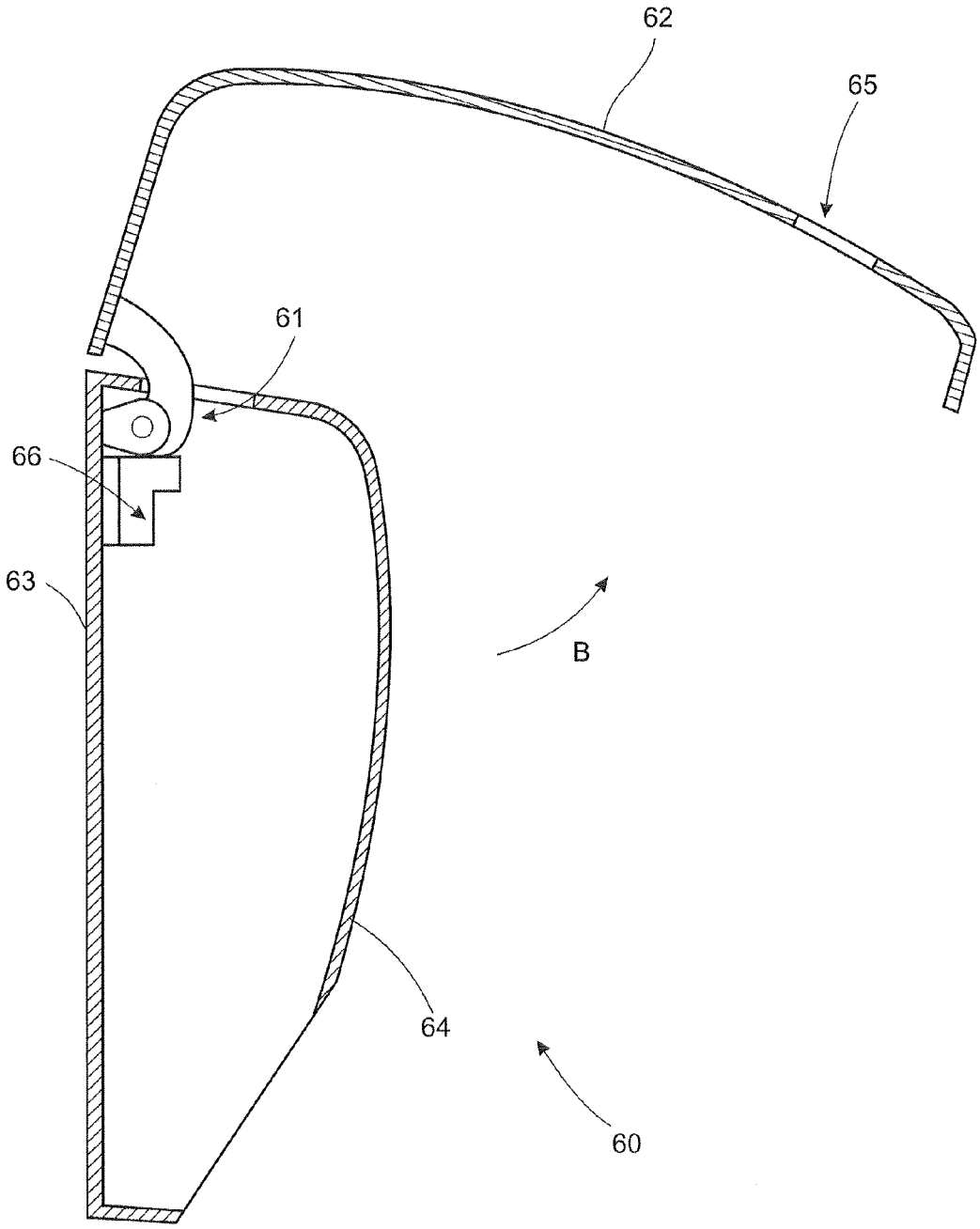
FIG. 6 shows a schematic illustration of an alternative dispenser provided with a hinge according to the invention.

FIG. 6 shows a schematic illustration of a wall mounted dispenser 60 for a stack of paper towels or similar provided with a hinge 61 according to the invention. According to this example, the dispenser 60 is provided with a front cover 62 hinged at the upper portion of the dispenser 60 by the hinge 61. The dispenser 60 comprises a rear wall 63 and a body 64 having an upper section and two side walls (not shown) arranged to enclose a stack of towels. The pivot axis of the hinge 61 is arranged substantially horizontally, parallel with the rear wall 63. The front cover 62 is provided with a dispensing opening 65 and is opened outwards and upwards, as indicated by the arrow B to allow access to the inside of the dispenser 60. In FIG. 6 the cover 62 is shown in an open position, where a spring loaded bar 66 is in contact with the hinge 61 and prevents the cover from closing. The spring loaded bar 66 is shown in its active position, at a predetermined angle relative to the rear wall 63 of the dispenser. The pivot axis of the spring loaded bar 66 is arranged substantially vertically, parallel with the rear wall 64.

The hinge 61 used for the dispenser 60 comprises a pair of first and second springs similar to the first and second coil springs described in connection with FIGS. 1-3 above. Hence, the coil spring corresponding to the second coil spring 25 (see FIG. 1) is acted on and pre-stressed by the second tubular element when the cover 62 is opened. Similarly, the coil spring corresponding to the first coil spring 23 is acted on by the second tubular element when the cover 62 is closed, whereby the damper element is actuated to brake the downwards movement of the cover 62.

In operation, referring to FIG. 6, a user wishing to open the cover 62 in order to re-fill or service the dispenser 60 is only required to release the cover 62, for instance by actuating a suitable locking mechanism (not shown). The cover 62 is then lifted by the user towards a first position, in this case corresponding to the open position, by pivoting the cover in the first direction against the action of the second spring. During this movement the user is only required to overcome the action of the second spring as the damper element is inactive during rotation in the said first direction. The opening movement will pretension the second spring so that it is ready to initiate the opening movement of the cover upon a subsequent release of the blocking mechanism. During re-filling or servicing the dispenser, the user will place a stack of towels in the dispenser. This action will cause the stack to act on the spring loaded bar 66 and return it to its inactive position. The spring loaded bar 66 will then release the hinge and the cover 62 will begin to close. The cover is pivoted in the second direction towards a second position, here corresponding to the initial closed position. The initial displacement can be assisted by the second spring and/or the weight of the cover. Depending on the degree of opening of the cover in the outwards and upwards direction, the first spring may be eliminated as the cover may return by gravity under its own weight. The damping element ensures that the opening movement will be performed in a controlled manner, at a relatively slow speed, by limiting the relative rate of rotation between the first and the third tubular members.

The invention is not limited to the above examples, but may be varied freely within the scope of the appended claims. For instance, the above examples describe the hinge according to the invention applied to a waste bin and paper towel dispensers. Alternatively, in a dispenser containing a re-fill container, such as a liquid soap container, the re-fill container itself may be used for controlling the blocking mechanism. In this case the cover is opened from an initial position into a servicing position to allow the re-fill container to be replaced. In this alternative example, a spring loaded bar is held in its inactive position by the re-fill container. During servicing, the cover is opened and held in its opened position by the user to allow the re-fill container to be removed. Removal of the re-fill container causes the spring loaded bar to be released and displaced into its active position, whereby the cover is prevented from closing. When the service is completed, a new re-fill container is placed in the dispenser. As the re-fill container is positioned in the dispenser it will simultaneously displace the spring loaded bar into its inactive position, whereby the cover is released and will begin to close.

The invention claimed is:

1. A hinge on as cover for a container, said hinge having a pivot axis and comprising:

at least one first member fixed against rotation;

at least one second member rotatable about said axis, said first and second members being arranged coaxially along said axis;

a third member arranged coaxial with the first and second members;

a damper element between the first and the third members in order to dampen the relative rate of rotation therebetween;

a first spring arranged between the second and the third members, said first spring being connected to the respective second and third members so that relative rotation therebetween is permitted in a first direction, when the cover is pivoted towards a first position, and prevented in a second direction, when the cover is pivoted towards a second position; and a second spring arranged between the first and second members, said second spring being connected to the respective first and second members so that rotation of the second member exerts a torque on said second member towards the second position of the cover.

2. The hinge according to claim 1, wherein the first spring is acted on by the second member and is arranged to expand and slide relative to the third member when the second member is being rotated in the first direction.

3. The hinge according to claim 1, wherein the first spring is acted on by the second member and is arranged to contract and be locked relative to the third member when the second member is being rotated in the second direction.

4. The hinge according to claim 1, wherein the first, second and third members are tubular members.

5. The hinge according to claim 4, wherein the damper element is provided between at least an outer surface of the third member and an inner surface of the first member.

6. The hinge according to claim 4, wherein the damper element is provided between at least an inner surface of the third member and an outer surface of the first member.

7. The hinge according to claim 4, wherein a first end section of the third member is arranged in a cylindrical or an annular recess in the first member.

8. The hinge according claim 4, wherein a second end section of the third member is arranged in a cylindrical or an annular recess in the second member.

9. The hinge according claim 4, wherein the damper element provided between the first and the third members comprises a damping fluid in a space between said first and third members.

10. The hinge according to claim 1, wherein the at least one second member comprises a first section containing the first spring and a second section containing the second spring, said first and second sections being mounted at opposite ends of the first member.

11. The hinge according to claim 1, further comprising a blocking mechanism to block the hinge in its first position.

12. The hinge according to claim 11, wherein the blocking mechanism is spring loaded towards its blocking position.

13. The hinge according to claim 12, wherein the blocking mechanism is mounted on an attachment portion of the hinge.

14. A container comprising a hinge according to claim 1.

15. The container according to claim 14, wherein the container is a waste bin with a lid arranged to be pivoted, said lid being attached to the waste bin by said hinge.

16. The container according to claim 14, wherein the container is a tissue or towel dispenser with a cover arranged to be pivoted, said cover being attached to the dispenser by said hinge.

17. The container according to claim 14, wherein the container is a liquid or viscous fluid dispenser with a cover arranged to be pivoted, said cover being attached to the dispenser by said hinge.

* * * * *

UNITED STATES PATENT AND TRADEMARK OFFICE

CERTIFICATE OF CORRECTION

PATENT NO. : 8,769,770 B2
APPLICATION NO. : 13/060087
DATED : July 8, 2014
INVENTOR(S) : Marcus Kullman et al.

It is certified that error appears in the above-identified patent and that said Letters Patent is hereby corrected as shown below:

In the Claims

Col. 12 line 54 in claim 1, line 1, "1. A hinge on as cover for a container," should read as "1. A hinge on a cover for container,".

Signed and Sealed this
Thirtieth Day of June, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 8,769,770 B2
APPLICATION NO. : 13/060087
DATED : July 8, 2014
INVENTOR(S) : Marcus Kullman et al.

It is certified that error appears in the above-identified patent and that said Letters Patent is hereby corrected as shown below:

In the Claims

Column 12, line 53 "1. A hinge on as cover for container," should read as "1. A hinge on a cover for a container,".

Signed and Sealed this
Tenth Day of November, 2015

Michelle K. Lee

Michelle K. Lee
*Director of the United States Patent and Trademark Office*